US011376197B2

(12) United States Patent
González Bueno et al.

(10) Patent No.: US 11,376,197 B2
(45) Date of Patent: Jul. 5, 2022

(54) DEVICE FOR UNITARY DOSAGE OF TABLETS OR PILLS

(71) Applicant: Industrias Plasticas Triana S.A., Barbera del Valles (ES)

(72) Inventors: Begoña González Bueno, Cerdanyola del Vallès (ES); Enric Rovira Costa, Cerdanyola del Vallès (ES)

(73) Assignee: Industrias Plasticas Triana S.A., Barbera del Valles (ES)

( * ) Notice: Subject to any disclaimer, the term of this patent is extended or adjusted under 35 U.S.C. 154(b) by 0 days.

(21) Appl. No.: 17/257,599

(22) PCT Filed: Jul. 4, 2019

(86) PCT No.: PCT/ES2019/070472
§ 371 (c)(1),
(2) Date: Jan. 4, 2021

(87) PCT Pub. No.: WO2020/012049
PCT Pub. Date: Jan. 16, 2020

(65) Prior Publication Data

US 2021/0267847 A1 Sep. 2, 2021

(30) Foreign Application Priority Data

Jul. 11, 2018 (EP) ..... 18382520

(51) Int. Cl.
*A61J 1/03* (2006.01)
*A61J 7/00* (2006.01)
*B65D 83/04* (2006.01)

(52) U.S. Cl.
CPC ..... *A61J 7/0076* (2013.01); *A61J 1/03* (2013.01); *B65D 83/0409* (2013.01); *B65D 2583/0486* (2013.01)

(58) Field of Classification Search
None
See application file for complete search history.

(56) References Cited

U.S. PATENT DOCUMENTS 2,683,554 A 7/1954 Mulhauser, Jr.
6,142,337 A 11/2000 Schreckenberg et al.
(Continued)

FOREIGN PATENT DOCUMENTS

WO WO 2014/145274 9/2014

OTHER PUBLICATIONS

European Search Report dated Jan. 11, 2019 From the European Patent Office Re. Application No. 18382520.7. (6 Pages).
(Continued)

*Primary Examiner* — Gene O Crawford
*Assistant Examiner* — Ayodeji T Ojofeitimi

(57) ABSTRACT

The invention relates to the unitary dosage of tablets or pills comprising a hollow body with a container housed in the same configured to store tablets or pills, the container having an outlet channel, a rotation mechanism connected to the container and configured to make it rotate, a dispensing mechanism connected to the hollow body and operatively connected to the rotation mechanism, configured to house and dispense a tablet or pill, as well as for actuating the rotation mechanism and stirring means connected to the hollow body and to the container, such that the actuation of the dispensing mechanism causes the rotation of the container, the tablets or pills being stirred by the operative combination of the rotation with the stirring means, and wherein during the actuation, the dispensing mechanism dispenses a tablet or pill and/or houses another to be dispensed.

11 Claims, 3 Drawing Sheets

(56) References Cited

U.S. PATENT DOCUMENTS

| | | | | |
|---|---|---|---|---|
| 2008/0116219 | A1* | 5/2008 | Lawrence | G07F 11/54 221/265 |
| 2017/0231871 | A1* | 8/2017 | Aldasouqi | A61J 7/0084 221/203 |
| 2017/0270274 | A1 | 9/2017 | Garcia et al. | |

OTHER PUBLICATIONS

International Search Report and the Written Opinion dated Nov. 4, 2019 From the International Searching Authority Re. Application No. PCT/ES2019/070472. (12 Pages).

* cited by examiner

DEVICE FOR UNITARY DOSAGE OF TABLETS OR PILLS

RELATED APPLICATIONS

This application is a National Phase of PCT Patent Application No. PCT/ES2019/070472 having International filing date of Jul. 4, 2019, which claims the benefit of priority of European Patent Application No. 18382520.7 filed on Jul. 11, 2018. The contents of the above applications are all incorporated by reference as if fully set forth herein in their entirety.

FIELD AND BACKGROUND OF THE INVENTION

The present invention relates to dispensing devices for lozenges, pills, tablets, capsules or similar, capable of dosing the amount of said elements to be dispensed from the device, and is particularly related to single-dose or unit-dispensing portable dispensing devices, which are configured to dispense a single pill or capsule every time said device is actuated by a means provided in the same for said purpose.

In the application field several devices capable of dispensing pills or similar at the user's will have been developed, by either manual or automatic actuation of said device.

One of the main problems in dispensing devices is the possible clogging that can occur by the unexpected compacting of the pills that does not allow the same to flow, or by an obstruction of the outlet channel when the pills are improperly positioned with respect to said channel. In both cases the dispensing device cannot be used and the user cannot receive the content thereof.

Some dispensing devices have been provided with guides for suitably directing the pills or tables towards the outlet, such as that which is disclosed in WO 2013/116646, which includes, among other aspects, a pill track and dispenser assembly 400 that is selected in view of the type of pill that is contained in the pill bottle. The pill track and dispenser assembly 400 includes two main parts, namely, a pill track member 410 and an insert 500 that couples to the pill track 410 and configures the pill track 410 to have a desired orientation that allows the pills to only travel in one predetermined desired orientation with respect to the pill track 410. The predetermined orientation can be a horizontal orientation, vertical orientation, or even a diagonal orientation, etc.

It can be seen from this prior art document that the pills are guided towards the dispensing outlet to avoid an obstruction due to an incorrect accommodation of the same, however, these tracks are complicated to obtain and the device disclosed therein is not envisaged to prevent a blockage due to compaction.

Another dispensing device, such as the one disclosed in U.S. Pat. No. 6,918,509, discloses a dispenser 10 that comprises a rotatable hopper 12, a hollow tubular structure formed from a single tube 14 and a tubular or hollow base plunger 16. The rotatable hopper 12 has an outer surface 18 and a cup 20 that extends through outer surface 18 into the interior of the hopper 12. The rotatable hopper 12 also has an axis of rotation 22 around which the hopper 12 rotates to dispense candy or other small objects. The cup 20 is of a sufficient size to contain at least one of the objects to be dispensed. The rotatable hopper 12 preferably has a cross section perpendicular to a rotational axis 22 that is, at least in part, substantially circular, and is most preferably, at least in part, spherical or cylindrical. The presence of cup 20 prevents the hopper 12 from having a completely circular cross section in that portion of hopper 12 where cup 20 is present. However, the rotatable hopper 12 may be of any shape that allows the hopper to rotate freely within tube 14. In addition, the tube 14 and base plunger 16 each have a circular cross section along the length of dispenser 10. However, the tube 14 and base plunger 16, and, thus, dispenser 10, each may have any cross sectional shape and size that may vary along the length of dispenser 10, as long as the shape and size of the cross section allows dispenser 10 to function.

In this US patent, it can be seen that the rotatable hopper in the rotation thereof introduces a small stirring in the candy which could unclog them from a possible compaction, however, the device disclosed therein is not conceived for said purpose, nor can it guarantee that the candy is properly guided to said rotatable hopper.

Thus, in the state of the art there is a need to provide a dispensing device that is able to stir and/or shake the capsules or pills or the content of the device to prevent clogging or remnants in the container that will be difficult to dispense, and which is also able to properly place said capsules or pills for dispensing in order to facilitate the dispensing of the same.

SUMMARY OF THE INVENTION

To overcome the current drawbacks, the present invention provides a device for the unitary dosage of tablets or pills that comprises a hollow body, a container housed in the hollow body configured to store tablets or pills, the container comprising an outlet channel, through which the tablets or pills exit said container, a rotation mechanism connected to the container and configured to make the same rotate, a dispensing mechanism connected to the hollow body and operatively connected to the rotation mechanism, configured to house and dispense a tablet or pill, as well as for actuating the rotation mechanism and stirring means connected to the hollow body and to the container, such that the actuation of the dispensing mechanism causes the rotation of the container through the rotation mechanism, the tablets or pills being stirred by the operative combination of the rotation with the stirring means, and wherein during the actuation, the dispensing mechanism dispenses a tablet or pill and/or houses another to be dispensed.

In alternative embodiments of the device for unitary dosage of tablets or pills, the stirring means comprise a wall portion connected to the hollow body that projects toward the inside of the container, and comprise stirring flaps connected to the container that project towards the inside of the same.

In other alternative embodiments of the device of the invention, the container comprises a storage portion that connects to the outlet channel through a transition portion.

In other even more alternative embodiments of the device, the stirring flaps are preferably provided on the transition zone.

In alternative embodiments of the device for the unitary dosage of tablets or pills, the rotation mechanism comprises a rack and pinion mechanism wherein the pinion is connected to the container and the rack is connected to the dispensing mechanism, wherein the outlet channel of the container passes through said pinion.

In other alternative embodiments of the device for unitary dosage of the invention, the dispensing mechanism comprises a plate element connected to a lower end of the hollow body and which defines a dispensing opening, elastic means connected to the plate element and/or to the hollow body and connected to an actuating element configured to be actuated by the user, and stroke limiting means connected to the plate element and/or to the hollow body and configured to limit the movement of the actuation element in the non-actuated position.

In alternative embodiments of the device, the actuation element comprises a channel configured to house a pill or tablet to be dispensed, such that when the actuation element is in a non-actuated state, the channel aligns with the container channel to receive and house a tablet or pill coming from the container, and such that when the actuation element is in an actuated state, the channel aligns with the dispensing opening of the plate element to dispense the pill or tablet, wherein by returning to the non-actuated state the channel can newly house a tablet or pill.

In other alternative embodiments the dispensing mechanism comprises guide elements configured to guide the movement of the actuation element.

In alternative embodiments the stroke limiting means of the dispensing mechanism comprise a wall that projects toward the inside of the hollow body and, in a non-actuated state, is configured to butt against the actuation element.

In other alternative embodiments of the device of the invention, the stroke limiting means of the dispensing mechanism comprise a wall that projects from the plate element in such a way that it partially encloses the actuation element and, in the non-actuated state, is configured to butt against the actuation element.

In other even more alternative embodiments of the device, the dispensing mechanism comprises fastening means connected to the plate element and configured to fasten the elastic means.

The main advantage of the invention consists of the fact that by means of a purely mechanical configuration of the rotation mechanism the stirring means are able to stir the pills every time the actuation element of the dispensing mechanism is actuated by the user. This way, when the user actuates the dispensing mechanism to obtain a pill, the stirring means stir the tablets or pills preventing or breaking up pills that are possibly compacted and facilitating the individual flow of the tablets or pills toward the outlet channel of the container, and thus the dispensing of the same.

BRIEF DESCRIPTION OF THE SEVERAL VIEWS OF THE DRAWINGS

The previous advantages and characteristics, in addition to others, shall be understood more fully in light of the following detailed description of exemplary embodiments, with reference to the drawings attached, which must be understood by way of illustration and not limitation, wherein.

DESCRIPTION OF SPECIFIC EMBODIMENTS OF THE INVENTION

The following detailed description presents a number of specific details by way of example to provide a detailed understanding of the relevant teachings. However, it is clear for a person skilled in the art that the present teachings can be carried out without these details.

Figure 1:
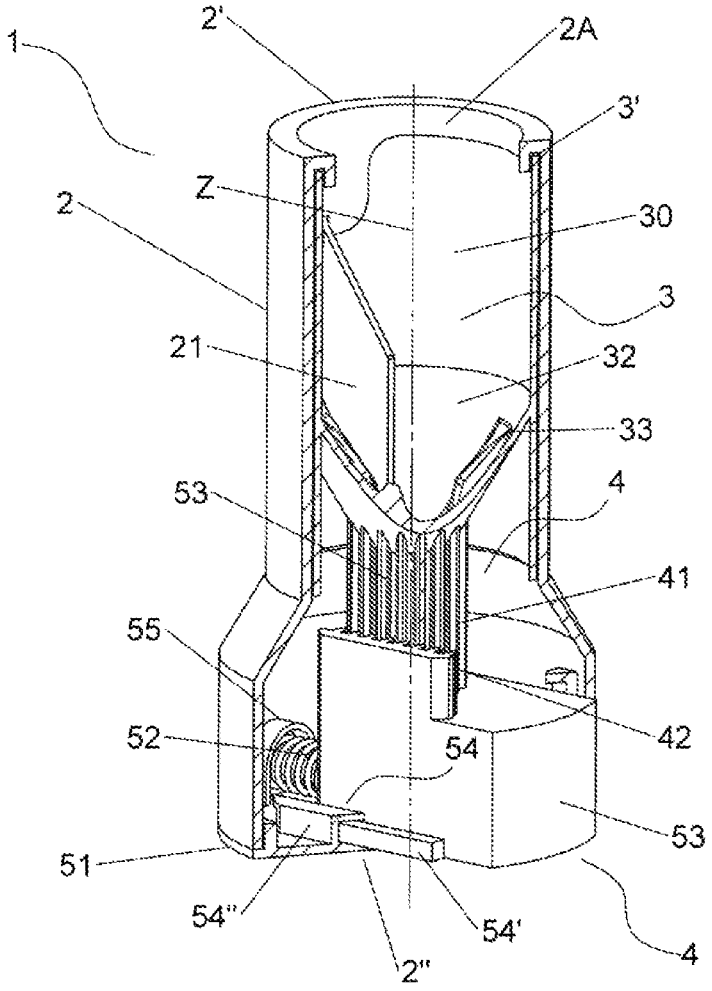
FIG. 1 is a perspective view of the device wherein some of the components thereof have been partially cut to facilitate the view of the interrelation of said components.
Figure 2:
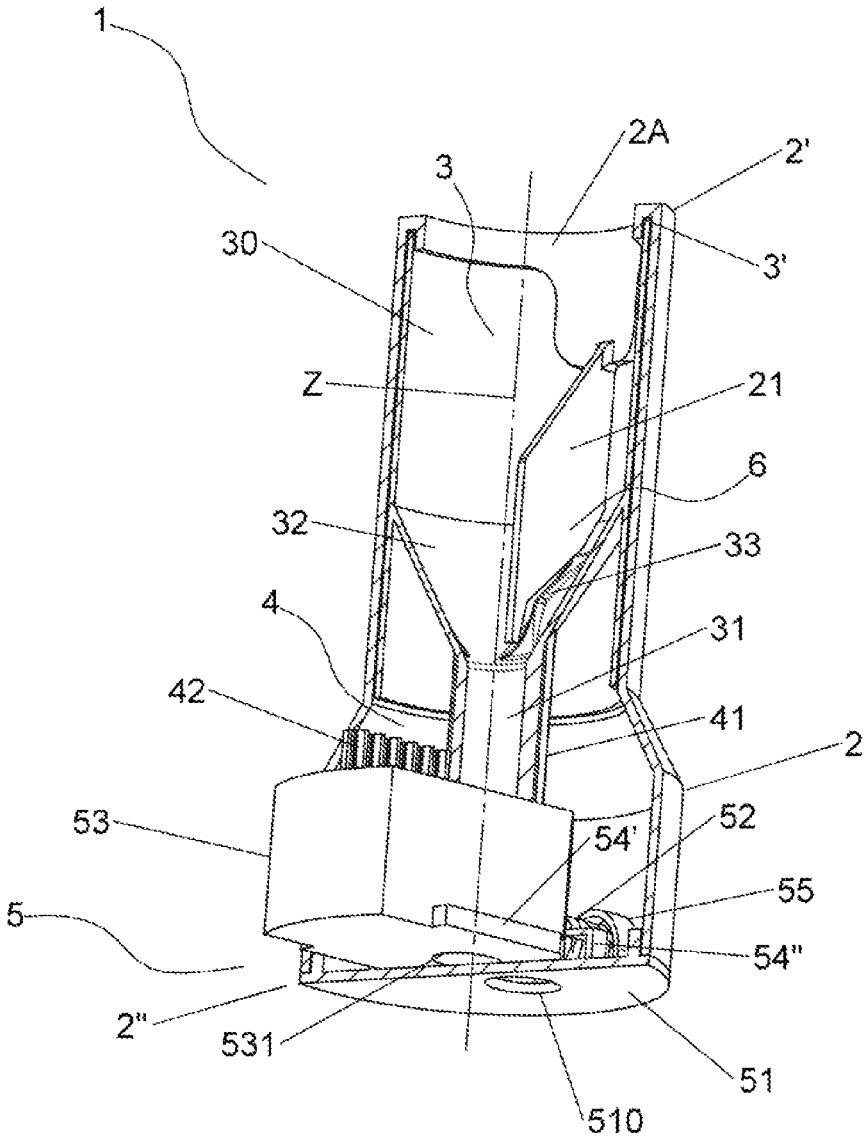
FIG. 2 is a perspective view from an different viewpoint and with a different cutting plane with respect to FIG. 1 of the device wherein some of the components thereof have been partially cut to be able to view the interrelation of said components.

According to the way it is shown in FIGS. 1 and 2, the present invention provides a device (1) for the unitary dosage of tablets or pills that comprises a hollow body (2) provided to house inside the same all of the components that form part of the device. Preferably, the hollow body (2) is essentially cylindrical, with portions that may vary in diameter along the extension of the hollow body (2), and is especially configured to house a container (3) that, as will be described in greater detail below, can rotate by the action of a rotation mechanism (4), and therefore the coupling of the container (3) to the hollow body (2) must be such that it allows the rotation of the first with respect to the second. For said purpose, defined on a first end (2') of the hollow body (2) is a protrusion (2A) configured to rotationally receive one end (3') of the container (3) that tightly butts against the same. The protrusion (2A) preferably has an L shape, although other configurations are acceptable without deviating from the scope of the invention.

As can be seen in FIG. 2, the aforementioned container (3) is configured to store tablets or pills (not shown) inside the same and comprises a storage portion (30), a transition portion (32) and an outlet channel (31), wherein the transition portion (32) connects the storage portion (30) to the outlet channel (31) through a transition portion (32). The container (3) defines an axial "Z" axis that extends through the same. Preferably, the storage portion (30) has an essentially cylindrical form and the transition portion (32) preferably has a truncated straight conical form, wherein the base of the cone connects to the storage portion (30) while the truncated end connects to the outlet channel (31). This "conical" transition portion (32) has the objective of preparing a path for the tablets or pills housed in the container (3) such that the tablets or pills that come out of the container (3) through the outlet channel (31) do so in a one-by-one fashion, and as such, the size of the outlet channel (31) must be greater than the smallest dimension of the tablet or pill being dispensed, but smaller than the largest dimension of the tablet or pill, such that two pills cannot pass through at the same time. For example, when the outlet channel (31) has a circular transverse cross section, the diameter of said channel is greater than the diameter of the tablet or pill, but smaller than twice the diameter of said tablet or pill.

A rotation mechanism (4) is operatively connected to the container (3) and is configured to make the same rotate with respect to the "Z" axis and comprises a rack and pinion mechanism (41) wherein the pinion (41) is connected to the container (3) and the rack (42) is connected to a dispensing mechanism (5), which will be referred to below. The connection of the pinion (41) to the container (3) is in the form of an operative coupling, wherein the axial axis of the pinion (41) coincides with the "Z" axis of the container, such that all of the rotation exerted on the pinion (41) is transmitted to the container (3). The pinion (41) is preferably coupled to the container (3) in such a way that the outlet channel (31) passes through said pinion (41) on the axial axis thereof. In even more preferred embodiments, the pinion (41) is integrally formed with the container (3).

On the other hand, and according to FIGS. 1 and 2, the device (1) of the invention comprises a dispensing mechanism (5) that is connected to the hollow body (2) through a plate element (51) that couples to a lower end (2") of said hollow body (2), wherein a dispensing opening (510) is defined in the plate element (51) and is configured so that the pills are dispensed from the device (1) to the user.

The dispensing mechanism (5) comprises an actuation element (53) envisaged to be actuated by the user, said actuation element able to be linearly moved over the plate element (51) between two positions referred to as "actuated" and "non-actuated", wherein elastic means (52) are coupled to the plate element (51) and coupled to the actuation element (53) and are configured to return the latter to the "non-actuated" position, which is the normal position of the actuation element in which there are no pills being dispensed. Guide elements (54) form part of the dispensing mechanism (5) and are configured to guide the linear movement of the actuation element (53). Preferably said guide elements (54) are configured as protrusions (54') provided on the actuation element (53) and guides (54") provided on the plate element (51).

Figure 3:
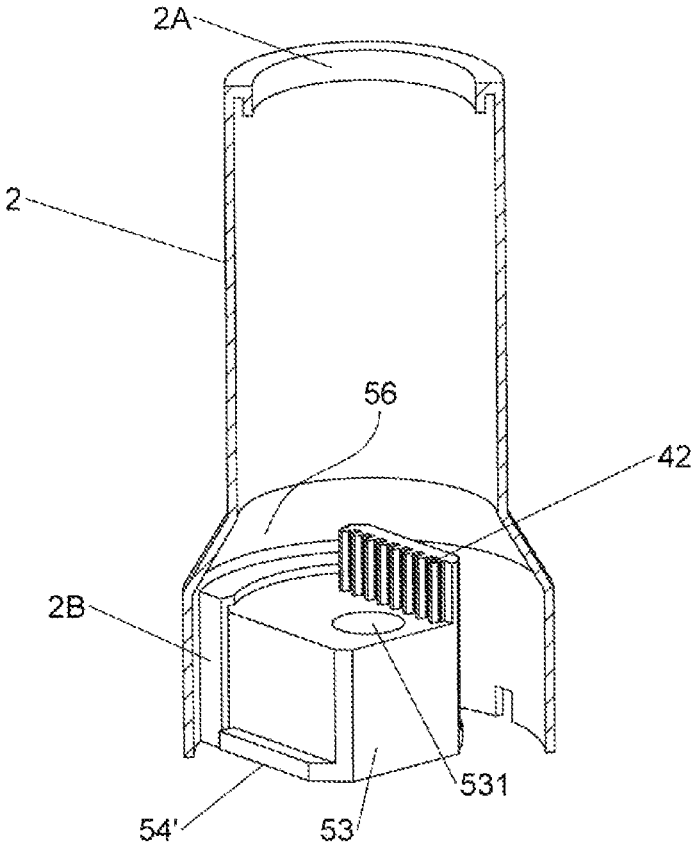
FIG. 3 is a perspective view wherein only the hollow body is shown, which has been partially cut, and the actuation element can be seen, wherein the position allows the stroke limiting means to be seen when configured as a wall that projects toward the inside from the hollow body.
Figure 4:
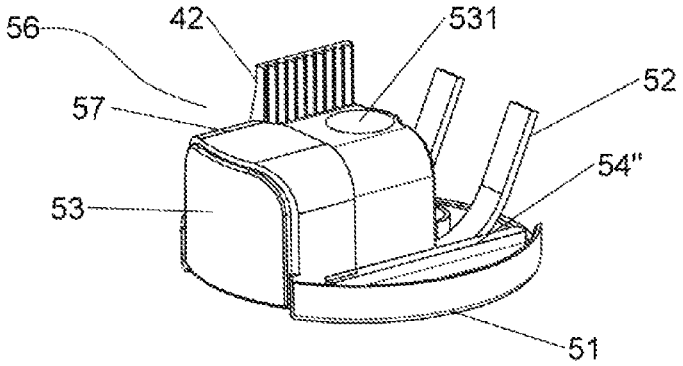
FIG. 4 is a view of the stroke limiting means when they are configured as a wall that extends from the plate element and partially encases the actuation element.

Likewise, and according to that which is shown in FIGS. 3 and 4, the dispensing mechanism (5) comprises stroke limiting means (56) configured to limit the movement of the actuation element (53) in a non-actuated position. These stroke limiting means (56) prevent the actuation element (53) from decoupling from the elastic means (52) and/or prevent it from being expelled out of the hollow body (2) by the action of said elastic means (52). It is clarified that in the non-actuated position, the elastic means (52) exert a tension in a preloading way in the actuation element (53) to maintain operative contact with the plate element (51) and/or with the hollow body (2).

FIG. 3 shows the stroke limiting means (56) configured as a wall (2B) that projects toward the inside of the hollow body (2) and which, in a non-actuated state, are configured to butt against the actuation element (53). In this embodiment the wall (2B) butts against the protrusions (54') of the actuation element (53), however, a person skilled in the art will be able to see that the wall (2B) can be placed to butt against another wall defined in the actuation element (53), defined for said purpose without deviating from the scope of the invention.

FIG. 4 shows another configuration of the stroke limiting means (56) configured as a wall (57) that projects from the plate element (51) in such a way that it partially encloses the actuation element (53), and in the non-actuated state, is configured to butt against said actuation element (53). In this embodiment the wall (57) butts against the rack (42), said rack (42) being coupled to, or forming part of, the actuation element (53), however, a person skilled in the art will be able to see that the wall (57) can be placed to butt against another wall defined in the actuation element (53), defined for said purpose without deviating from the scope of the invention. In preferred embodiments, the wall (57) can be an independent element that couples to the plate element (51); in other embodiments it is able to be an element integrally formed with the plate element (51).

On the other hand, the actuation element (53) comprises a channel (531) configured to house a pill or tablet to be dispensed, such that when the actuation element (53) is in a non-actuated state, the channel (531) aligns with the container channel (3) to receive and house a tablet or pill coming from the container (3), and such that when the actuation element (53) is in an actuated state, the channel (531) aligns with the dispensing opening (510) of the plate element (51) to dispense the pill or tablet, in this state the channel (31) being blocked by the actuation element (53), wherein by returning to the non-actuated state the channel (531) can newly house a tablet or pill. Thus, the dispensing opening (510) is not aligned with the channel (31) of the container (3).

As can be seen in FIGS. 1 and 2, the dispensing mechanism (5) is operatively connected to the rotation mechanism (4) to actuate the same. Preferably, the rack (42) of the rack and pinion mechanism is provided in the actuation element (53) of the dispensing mechanism (5) where the orientation of the gear stroke of said rack (42) is oriented in the same direction as the linear movement of the actuation element (53). This way, when the actuation element (53) is actuated, the linear movement of the same causes the linear movement of the rack (42), which, by meshing with the pinion (41), makes the same rotate, which in turn makes the container (3) rotate.

The device (1) for the unitary dosage of tablets or pills of the invention further comprises stirring means (6) which, as will be shown below, are connected to the hollow body (2) and to the container (3).

These stirring means (6) are the combination of a static part and a mobile part. The static part is defined as a wall portion (21) related to the hollow body (2) and which projects towards the inside of the same, moving inside the container (3). It is termed static because, due to the fact that said wall (21) is connected to the hollow body (2), it remains fixed to the same. In the embodiment shown in FIGS. 1 and 2, a single wall portion (21) is shown which projects in an orientation that intersects the "Z" axis, however, as many wall portions (21) as one would like can be placed, wherein the orientations of the same can be different from the projection towards the "Z" axis. In some embodiments, the wall portion (2) is an independent element that couples to the hollow body (2). In other embodiments, the wall portion (21) is integrally formed with the hollow body (2).

On the other hand the mobile part of the stirring means (6) comprises stirring flaps (33) connected to the container (3) and which project toward the inside of the same. These stirring flaps (33) are called mobile because by being connected to the container (3) they rotate with the same, and therefore they move with respect to the wall portion (21). As can be seen in FIG. 1, the stirring flaps (33) are preferably provided in the transition zone (32) where the projection of said stirring flaps (33) is oriented towards the "Z" axis, although other projection directions are within the scope of the invention. The stirring flaps (33) can be independent elements that couple to the container or, in other embodiments, can be elements integrally formed with the container (3).

As can be seen in FIGS. 1 and 2, the elastic means (52) can be configured as a spring that fits between the fastening means (55) and the actuation element (53). FIG. 4 shows that the elastic means (55) are configured as elastic plates that extend from the actuation element (53) and preferably rest against the hollow body (2). In this embodiment, the elastic plates can be integrally formed with the actuation element (53) with an elastic modulus that allows the actuation to be carried out without permanent deformation.

When the container (3) rotates, the stirring flaps (33) drag the tablets or pills so that they hit against the wall portion (21) of the hollow body. This leads to a stirring a that causes the pills or tablets to separate if they happen to be compacted and also more effectively directs them to the outlet channel (31) so that they fan finally be dispensed. Thus, every time the actuation element (53) is actuated by the user, the pills or tablets are stirred by the stirring means.

What is claimed is:

1. A device (1) for unitary dosage of tablets or pills, comprising:

a hollow body (2);

a container (3) housed in the hollow body (2) configured to house tablets or pills, the container (3) comprising an outlet channel (31) through which the tablets or pills exit said container (3);

a rotation mechanism (4) connected to the container (3) and configured to make the same rotate;

a dispensing mechanism (5) connected to the hollow body (2) and operatively connected to the rotation mechanism (4), configured to house and dispense a tablet or pill, as well as to actuate the rotation mechanism (4); and stirring means (6), connected to the hollow body (3) and to the container (3), comprising a wall portion (21) connected to the hollow body (2) which projects towards the inside of the container (3);

such that the actuation of the dispensing mechanism (5) causes the rotation of the container (3) by means of the rotation mechanism (4), the tablets or pills being stirred by the operative combination of the rotation of the stirring means (6); and wherein the actuation of the dispensing mechanism (5) dispenses a tablet or pill and/or houses another to be dispensed.

2. The device according to claim 1, wherein the rotation mechanism (4) comprises a rack and pinion mechanism wherein the pinion (41) is connected to the container (3) and the rack (42) is connected to the dispensing mechanism (5), wherein the outlet channel (31) of the container (3) passes through said pinion (41).

3. The device according to claim 1, wherein the stirring means (6) comprises stirring flaps (33) connected to the container (3) which project toward the inside of the same.

4. The device according to claim 1, wherein the container (3) comprises a storage portion (30) that connects to the outlet channel (31) through a transition portion (32).

5. The device according to claim 3, wherein the stirring tabs-flaps (33) are preferably provided in the transition zone (32).

6. The device according to claim 1, wherein the dispensing mechanism (5) comprises:

a plate element (51) connected to a lower end (2") of the hollow body (2) and which defines dispensing opening (510);

elastic means (52) connected to the plate element (51) and/or the hollow body (2) and connected to an actuation element (53) configured to be actuated by the user; and stroke limiting means (56) connected to the plate element (51) and/or the hollow body (2) configured to limit the movement of the actuation element (53) in the non-actuated position.

7. The device according to claim 6, wherein the actuation element (53) comprises a channel (531) configured to house a pill or tablet to be dispensed, such that when the actuation element (53) is in a non-actuated state, the channel (531) aligns with the channel (31) of the container (3) to receive and house a tablet or pill coming from the container, and such that when the actuation element (53) is in an actuated state, the channel (531) aligns with the dispensing opening (510) of the plate element (51) to dispense the pill or tablet, wherein by returning to this non-actuated state the channel (531) can newly house a tablet or pill.

8. The device according to 6, wherein the dispensing mechanism (5) comprises guide elements (54) configured to guide the movement of the actuation element (53).

9. The device according to claim 6, wherein, in the dispensing mechanism (5), the stroke limiting means (56) comprise a wall (2B) that projects toward the inside of the hollow body (2) and which, in a non-actuated state, is configured to butt against the actuation element (53).

10. The device according to claim 6, wherein, in the dispensing mechanism (5), the stroke limiter means (56) comprise a wall (57) that projects from the plate element (51) in such a way that it partially encloses the actuation element (53) and, in the non-actuated state, is configured to butt against the actuation element (53).

11. The device according to claim 6, wherein the dispensing mechanism (5) comprises fastening means (55) connected to the plate element (51) and configured to fasten the elastic means (52).

* * * * *